US007628050B2

(12) United States Patent
Nishi et al.

(10) Patent No.: US 7,628,050 B2
(45) Date of Patent: Dec. 8, 2009

(54) PRESS-WORKING METHOD

(75) Inventors: Toshio Nishi, Kawachinagano (JP); Hirofumi Inoue, Sakai (JP)

(73) Assignee: Kubota Corporation, Osaka (JP)

( * ) Notice: Subject to any disclaimer, the term of this patent is extended or adjusted under 35 U.S.C. 154(b) by 181 days.

(21) Appl. No.: 11/519,187

(22) Filed: Sep. 11, 2006

(65) Prior Publication Data

US 2007/0209190 A1 Sep. 13, 2007

(30) Foreign Application Priority Data

Mar. 3, 2006 (JP) ..... 2006-057902

(51) Int. Cl.
*B21D 28/00* (2006.01)
*B21D 31/02* (2006.01)

(52) U.S. Cl. ..... 72/335; 72/336; 72/379.2

(58) Field of Classification Search ..... 72/334–338, 72/379.2, 411, 377, 358, 359; 29/891, 413; 83/25, 51

See application file for complete search history.

(56) References Cited

U.S. PATENT DOCUMENTS

| | | | | | |
|---|---|---|---|---|---|
| 1,761,888 | A * | 6/1930 | Junkers | 72/303 |
| 1,965,716 | A * | 7/1934 | Thoms et al. | 72/377 |
| 1,991,689 | A * | 2/1935 | McClintock | 72/339 |
| 2,166,226 | A * | 7/1939 | Vehko | 29/6.1 |
| 2,377,974 | A * | 6/1945 | Sherman | 72/376 |
| 2,947,344 | A * | 8/1960 | Springer | 72/411 |
| 3,156,034 | A * | 11/1964 | Gruetjen | 29/897.2 |
| 4,403,495 | A * | 9/1983 | Talbot | 72/383 |
| 4,545,170 | A * | 10/1985 | Shirey | 52/670 |
| 6,378,351 | B1 * | 4/2002 | Ouchi et al. | 72/336 |
| 6,553,805 | B1 * | 4/2003 | Gruber | 72/336 |
| 2001/0052255 | A1 * | 12/2001 | Arai | 72/379.2 |

FOREIGN PATENT DOCUMENTS

| | | |
|---|---|---|
| JP | 06-142776 | 5/1994 |
| JP | 2002102934 | 4/2002 |
| JP | 2003278176 | 10/2003 |

* cited by examiner

*Primary Examiner*—Dana Ross
*Assistant Examiner*—Debra M Sullivan
(74) *Attorney, Agent, or Firm*—The Webb Law Firm

(57) ABSTRACT

A press-working method comprises: cutting out a member with a predetermined shape from a sheet material, the member having a longitudinal direction; bending the member with the predetermined shape to form a bottom portion and a wall portion extending at an angle from the bottom portion as seen in a direction along the longitudinal direction such that the bottom portion has an arched surface as seen in a side view, using at least one plunger and at least one die, wherein an edge of the wall portion is allowed to expand along the plunger and the die while changes in a thickness of the wall portion is controlled by the plunger and the die, and wherein the step of cutting out a member is performed such that the wall portion has an edge with a preset shape after the bending step.

12 Claims, 9 Drawing Sheets

Fig.3
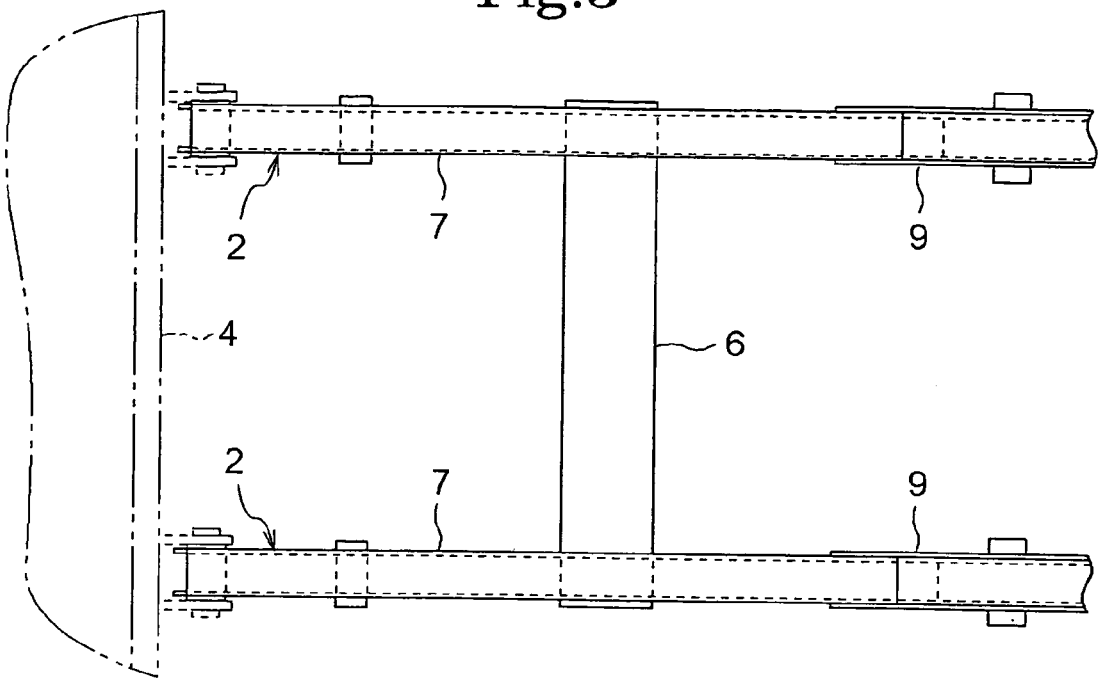
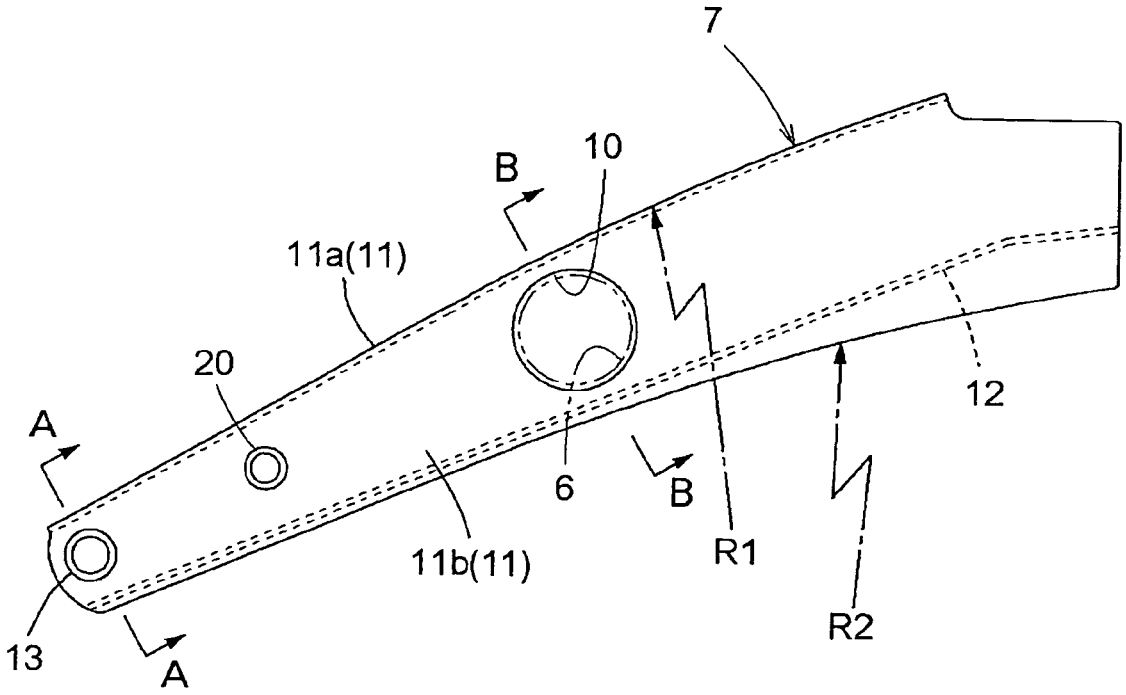
Fig.4

Fig.7
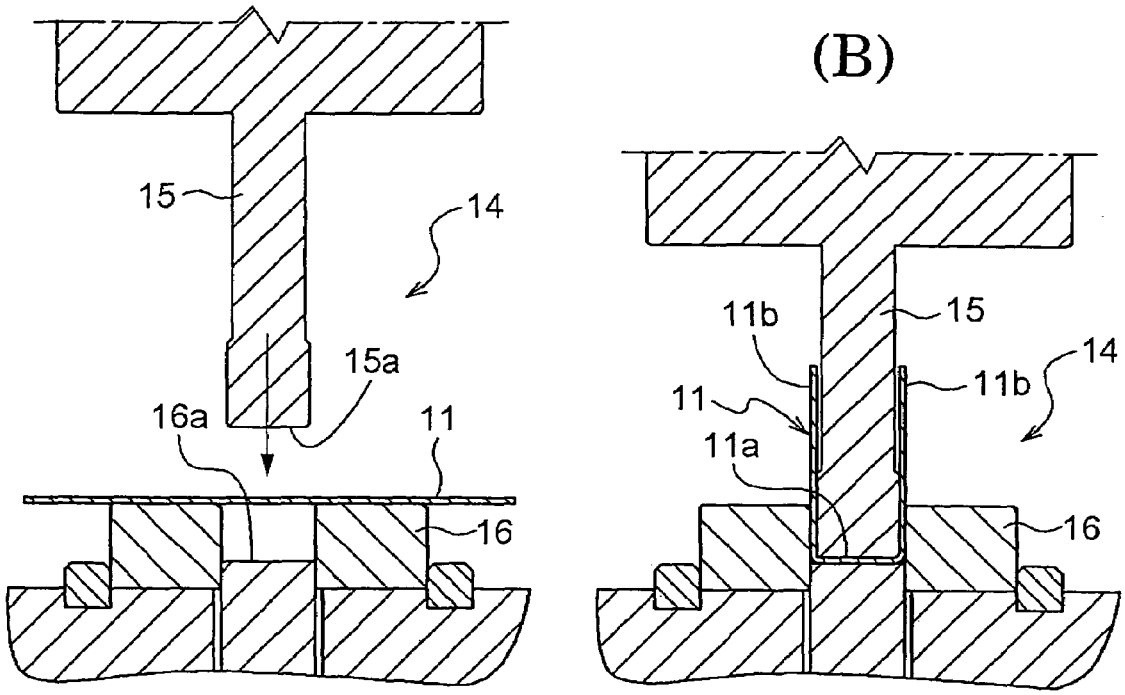
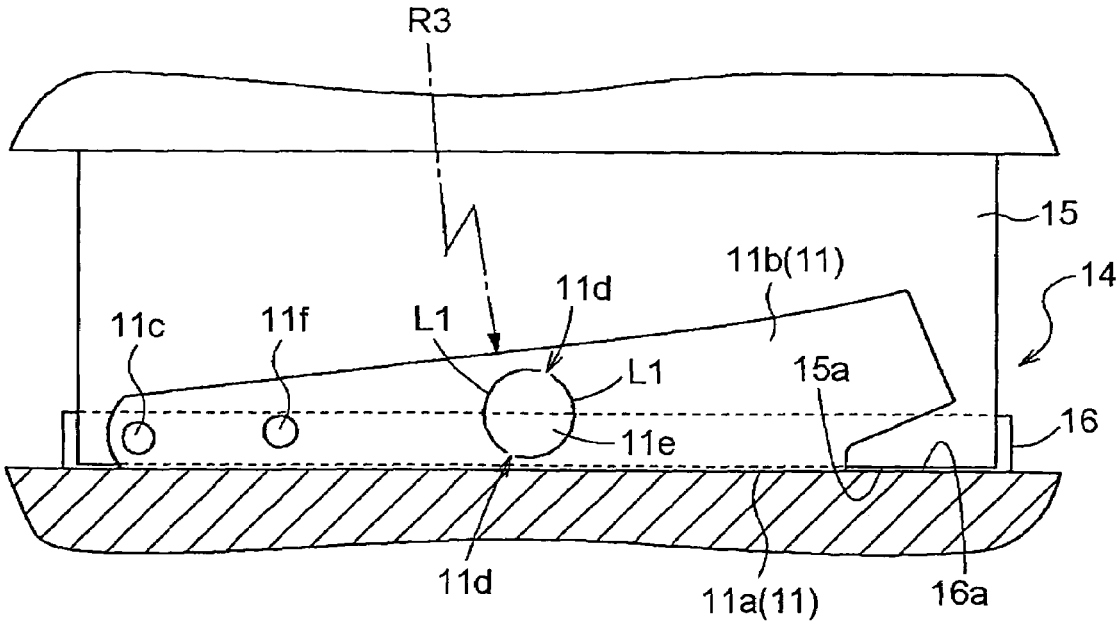
Fig.8

Fig.9
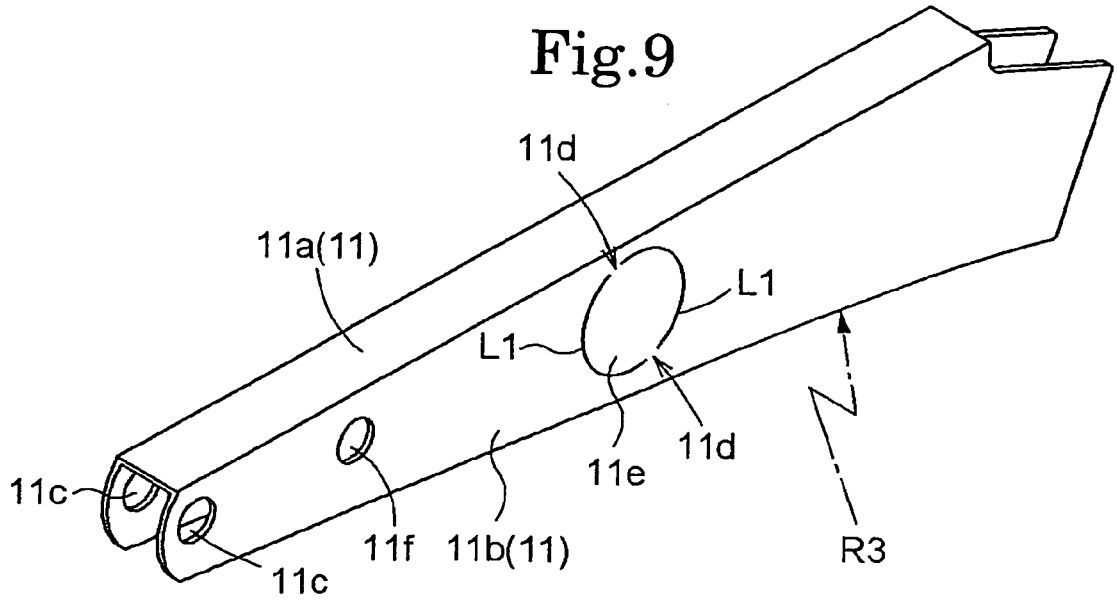
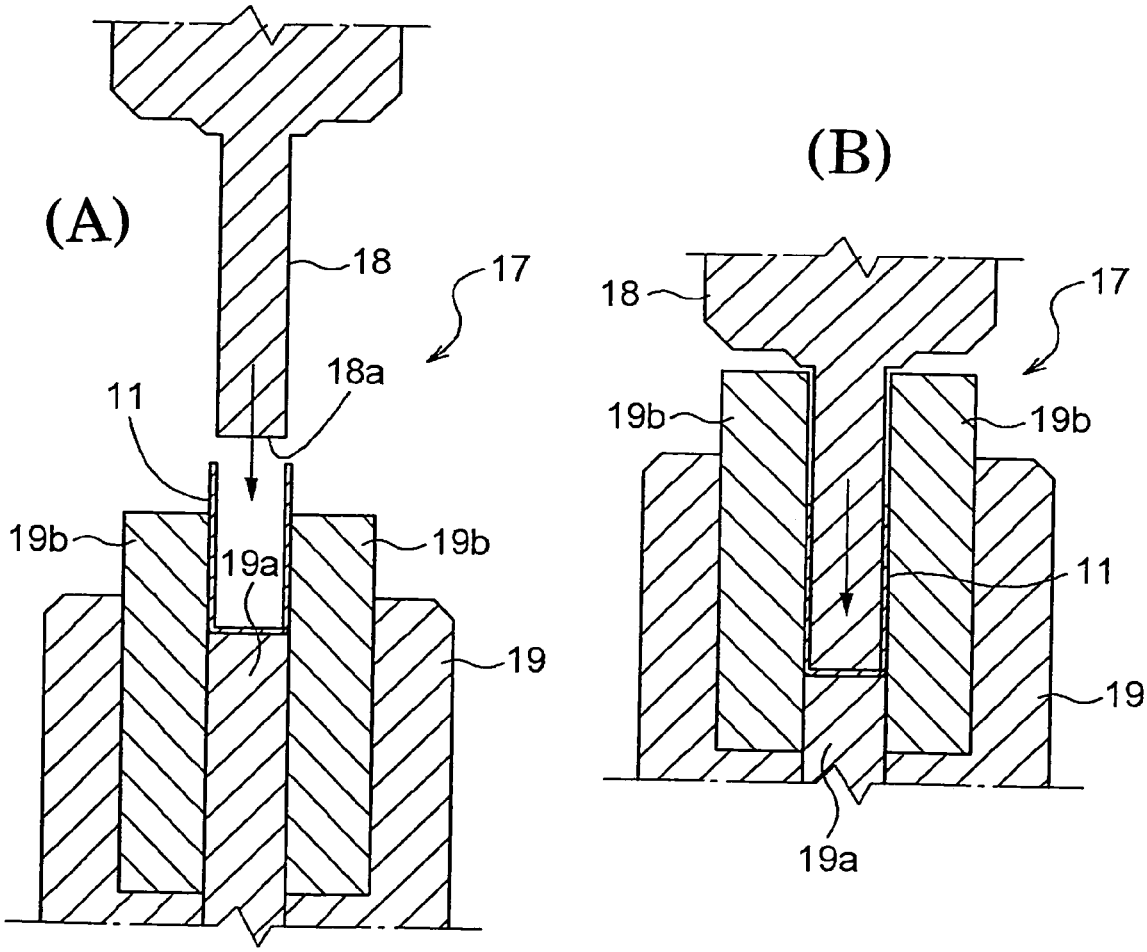
Fig.10

Fig.13
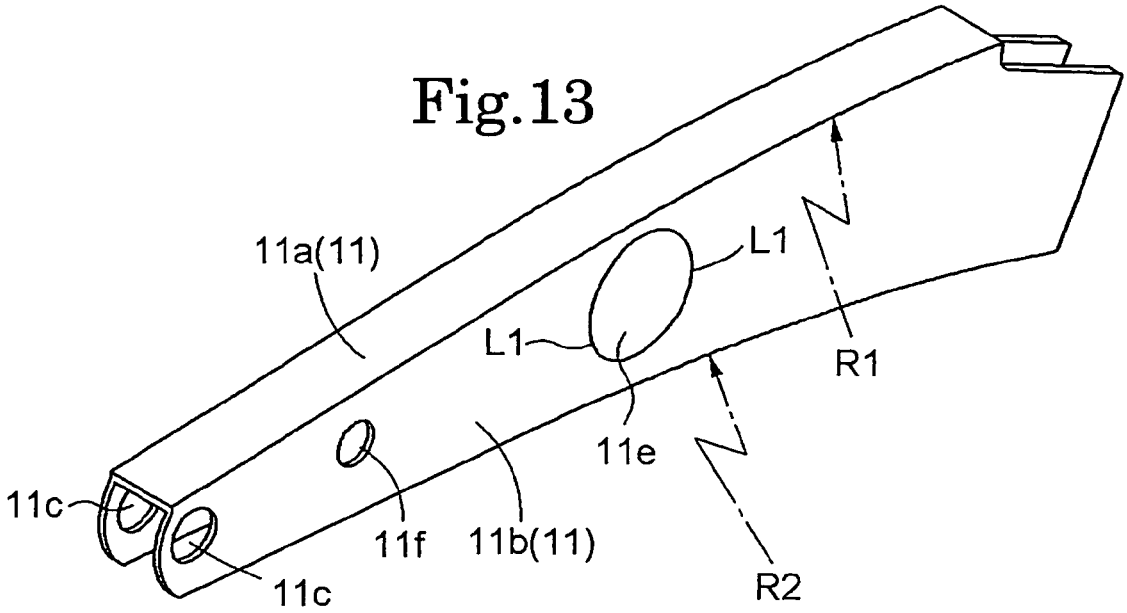
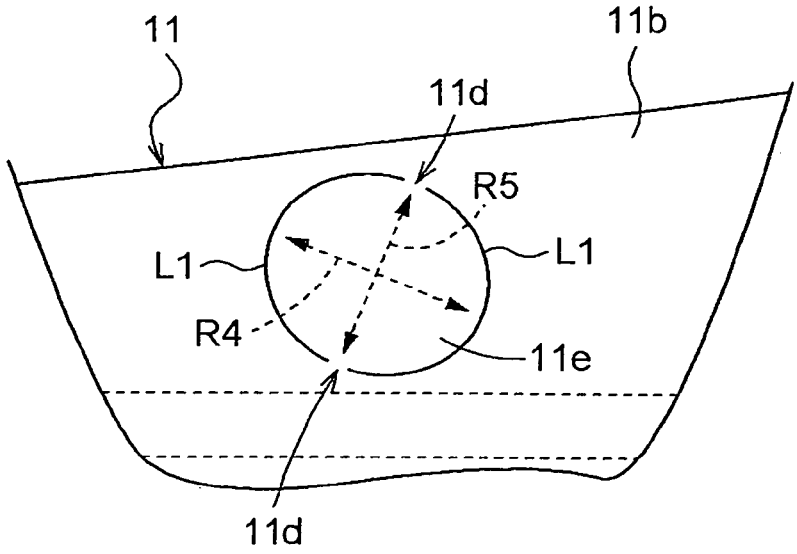
Fig.14

Fig.15 (PRIOR ART)
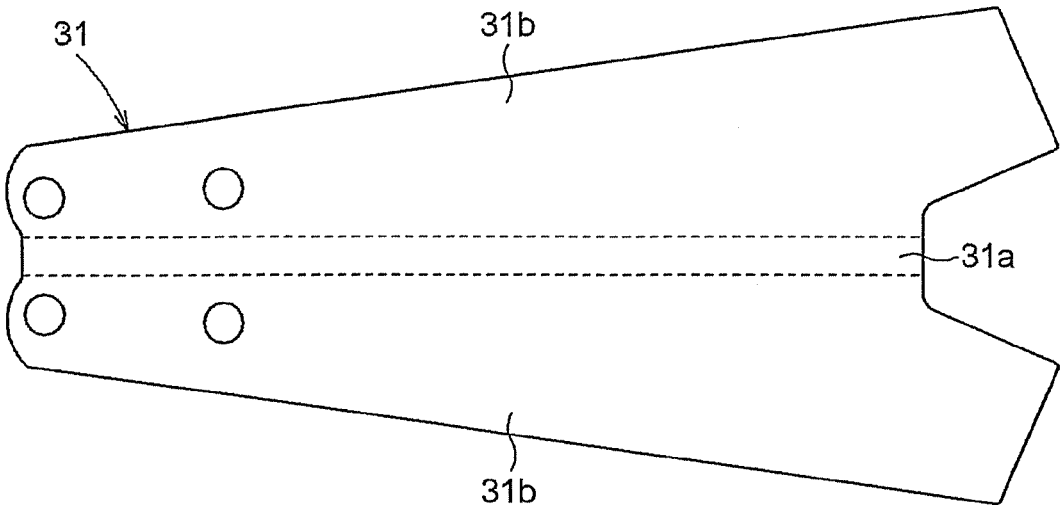
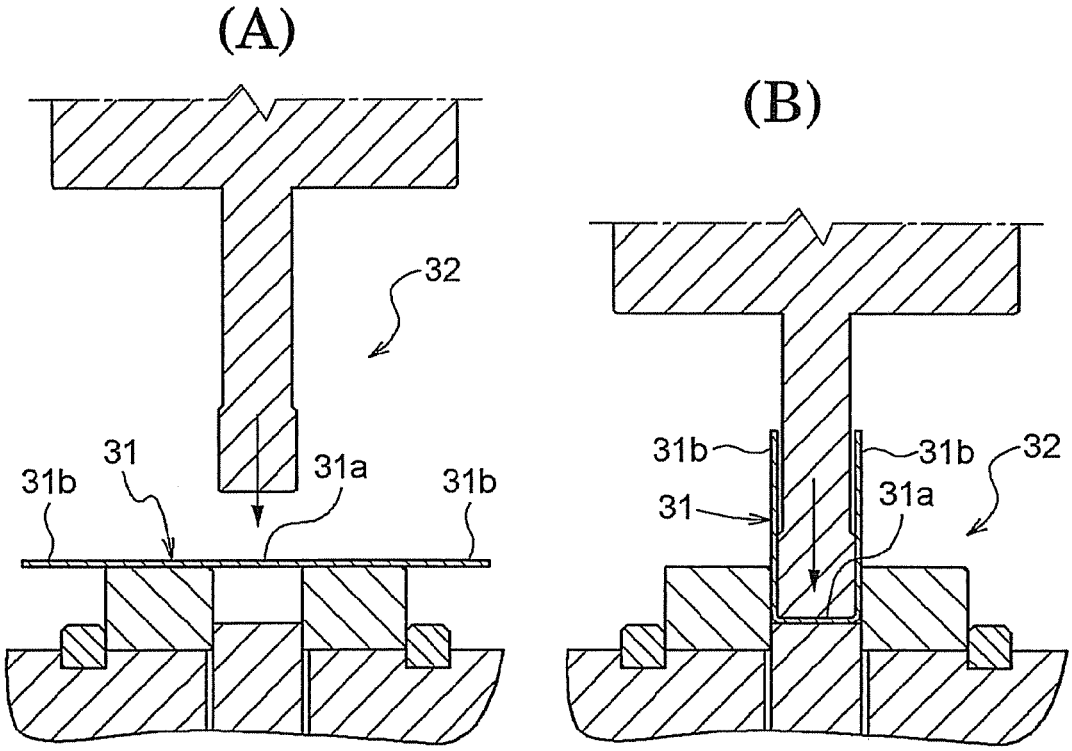
Fig.16 (PRIOR ART)

PRESS-WORKING METHOD

BACKGROUND OF THE INVENTION

The present invention relates to a press-working method in which a blank is cut out from a sheet material and the cut-out blank is press-worked.

An agricultural tractor such as that disclosed in Japanese Patent No. 2003-278176 (FIGS. 1, 3, 8, 11) has a front loader, which is an example of a excavating equipment, connected to a front part of a machine body, wherein the front loader comprises right and left booms, a bucket, and the like. The booms comprise a front structural member, a rear structural member, and an intermediate structural member. The front and intermediate structural members and the rear and intermediate structural members are respectively connected by welding.

The front and rear structural members are bent to have a U-shaped cross section, and a flat-plate lower wall is connected to a side wall (wall) by welding. In this case, as described in FIGS. 15-16, the front and rear structural members of the booms are blanks (31) having a predetermined shape that have been cut out from a sheet material and then bent by a pressing device (32) so as to have a U-shaped cross section to whose rear a lower wall is connected by welding.

The upper walls (bottom portions) of the front and rear structural members are configured to have a flat plane surface. Over the past several years, proposals have been made for the upper walls (bottom portions) of the front and rear structural members to be endowed with an arched surface in order to improve the strength and design of the booms.

In this case, when the blank is bent into a U-shape by the pressing device so that the upper walls of the front and rear structural elements have an arched surface while the blank is bent, the side walls (31*b*) of the front and rear structural members are compressed along the surfaces, and the side walls (31*b*) of the front and rear structural elements are expected to form a rippled state (be in a wrinkled state, or a state in which there are deformations in the board thickness direction).

A rippled state (a wrinkled state, or a state in which there are deformations in the board thickness direction) of the side walls (the walls of the blank) of the front and rear structural members must, therefore, be prevented by having changes in the board thickness of the side walls (the walls of the blank) of the front and rear structural members controlled by inside and outside molds, as disclosed in Japanese Patent No. 6-142776 and Japanese Patent No. 2002-102934.

In the abovementioned manner, when the blank (31) is bent to have a U-shaped cross section and the bottom of the blank is bent into an arched surface (31*a*), the edges of the walls (31*b*) of the blank will extend along the inside and outside molds if changes in the thickness of the walls (31*b*) of the blank are controlled by the inside and outside molds. Therefore, the expectation is that the edges of the walls (31*b*) of the blank will deviate from the predetermined shape (will become larger than the predetermined shape).

Therefore, when the blank is in such a state, the edges of the walls of the blank must be machined (e.g., cut with a laser) to yield the predetermined shape. In this case, machining is difficult if the edges of the walls of the blank are not flat but are in a bent state, and inevitably also entails increases in both the number of production steps and the production costs.

SUMMARY OF THE INVENTION

An object of the present invention is to eliminate the need for machining the edges of the walls of a blank (an object of the present invention is to minimize the scale and scope of machining even if machining is required) while minimizing the rippled state (wrinkled state, or a state in which there are deformations in the thickness direction) of the walls of the blank in a press-working method wherein the blank is bent so as to have a bottom part and walls (e.g., into a U-shaped cross section, a V-shaped cross section, or an L-shaped cross section), and the bottom of the blank is bent into an arched surface.

A press-working method in accordance with the present invention comprises: cutting out a member with a predetermined shape from a sheet material, the member having a longitudinal direction; bending the member with the predetermined shape to form a bottom portion and a wall portion extending at an angle from the bottom portion as seen in a direction along the longitudinal direction such that the bottom portion has an arched surface as seen in a side view, using at least one plunger and at least one die, wherein an edge of the wall portion is allowed to expand along the plunger and the die while changes in a thickness of the wall portion is controlled by the plunger and the die, and wherein the step of cutting out a member is performed such that the wall portion has an edge with a preset shape after the bending step.

Another object is to provide a method that facilitates forming an opening in a worked material.

To this end, a press-working method in accordance with the present invention comprises: cutting out a member with a predetermined shape from a sheet material, the member having a longitudinal direction; forming a cut-out portion, in an region where an opening is to be formed in the member with the predetermined shape, while allowing a blank part to remain inside the opening, the cut-out portion corresponds to an outer contour of the opening; bending the member with the predetermined shape such that the outer contour of the opening is deformed.

BRIEF DESCRIPTION OF THE DRAWINGS

FIG. 3 is a plan view of the boom of the front loader;

FIG. 4 is a side view of a front structural member of the boom;

FIG. 7A and FIG. 7B are longitudinal sectional views showing a state in which the first member is bent to have a U-shaped cross section by a first pressing device;

FIG. 8 is a longitudinal sectional side view showing a state in which the first member is bent to have a U-shaped cross section by the first pressing device;

FIG. 9 is a perspective view showing a state in which the first member is bent to have a U-shaped cross section by the first pressing device;

FIG. 10A and FIG. 10B are longitudinal sectional front views showing a state in which the bottom of the first member is bent into an arched surface by a second pressing device;

FIG. 13 is a perspective view showing a state in which the bottom part of the first member is bent into an arched surface by the second pressing device;

FIG. 14 is a plan view showing a state in which a pair of semicircular section lines and a connecting part of the first member are formed in a first alternate embodiment of the invention;

FIG. 15 is a plan view showing a state in which a blank has been cut out from a sheet material in prior art; and FIG. 16 is a longitudinal sectional front view showing a state in which a blank is bent to have a U-shaped cross section by a pressing device in prior art.

DETAILED DESCRIPTION OF THE PREFERRED EMBODIMENTS

While a number of embodiments are described herein, features from one embodiment may be combined with features from other embodiments. Such combination is understood to be within the scope of the present invention.

Figure 1:
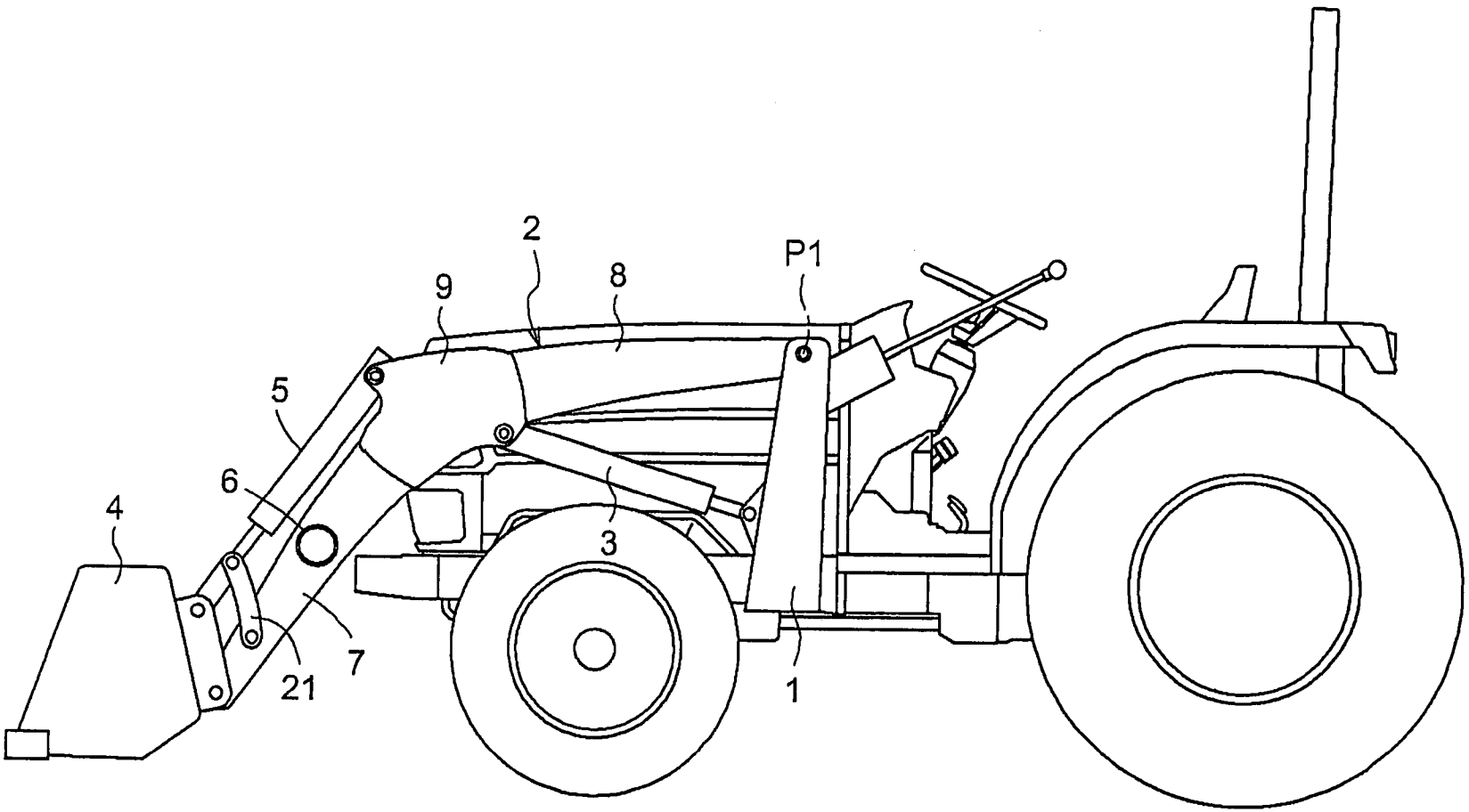
FIG. 1 is a side view of an entire agricultural tractor in a state in which a front loader is connected to a front of a machine body.

FIG. 1 shows a state in which a front loader has been connected to a front of a machine body in an agricultural tractor. The front loader comprises, e.g., left and right booms 2 vertically pivotably supported around a horizontal shaft core P1 of an upper part of a support frame 1 connected to the machine body; left and right hydraulic cylinders 3 for driving the vertical oscillation of the booms 2; a bucket 4 vertically pivotably supported by the fronts of the booms 2; left and right hydraulic cylinders 5 for driving the vertical oscillation of the bucket 4; and a frame 6 connected across the left and right booms 2.

Figure 2:
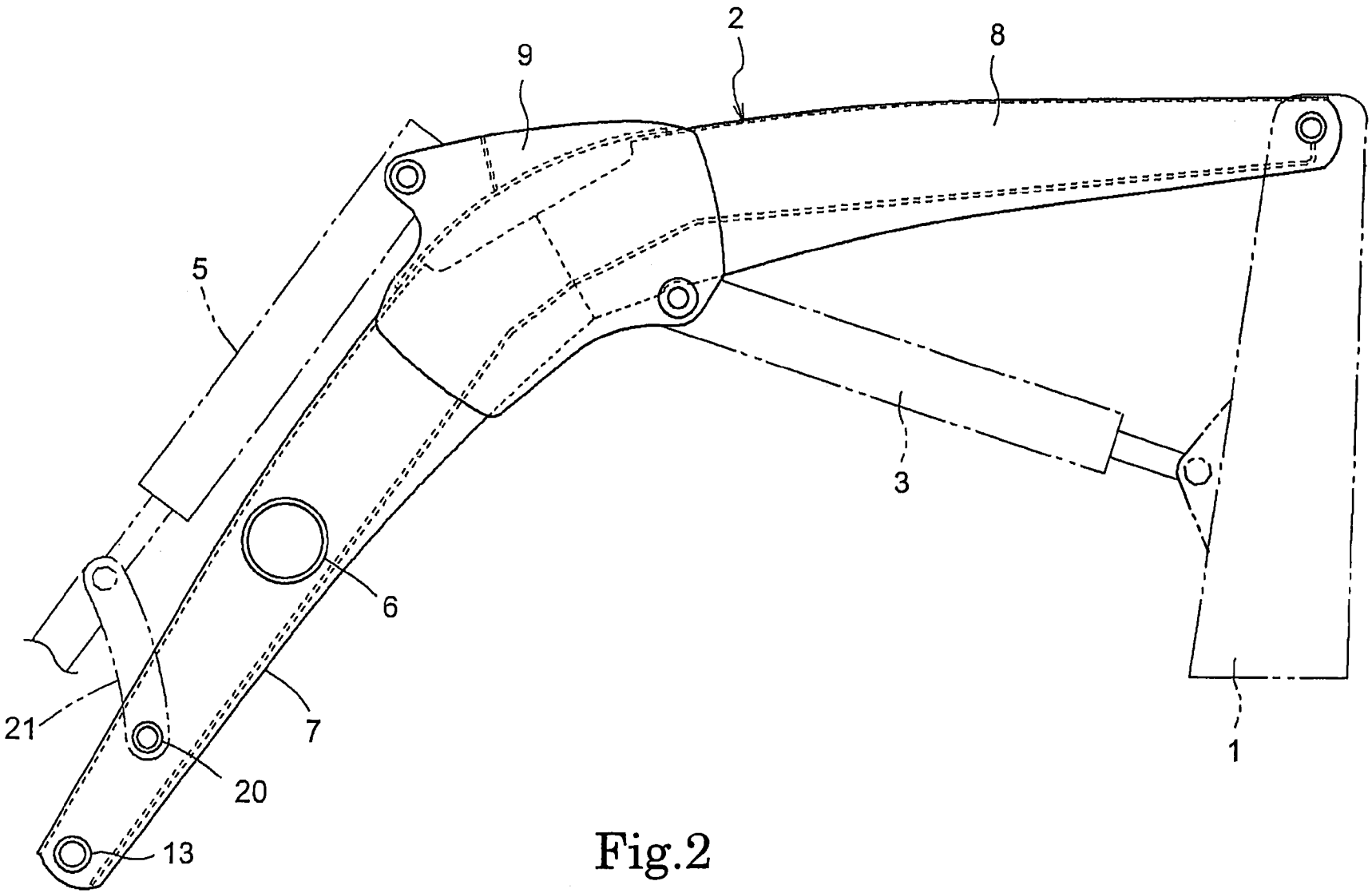
FIG. 2 is a side view of a boom of the front loader.

As shown in FIGS. 2 and 3, the boom 2 comprises a front structural member 7, a rear structural member 8, and an intermediate structural member 9; the front structural member 7 and the intermediate structural member 9 are connected by welding, as are the rear structural member 8 and the intermediate structural member 9; and the frame 6 is connected by welding across the left and right front structural members 7. The hydraulic cylinder 3 is connected across the support frame 1 and the intermediate structural members 9, and the hydraulic cylinder 5 is connected across the bucket 4 and the intermediate structure member 9.

Figure 5:
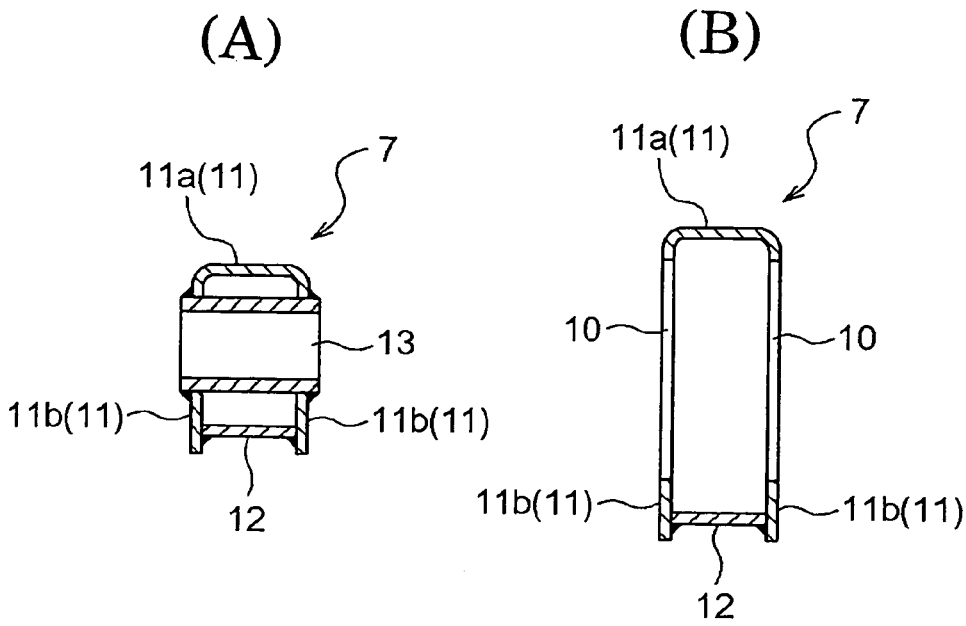
FIG. 5A is a cross-sectional view seen from the A-A direction of FIG. 4.
FIG. 5B is a cross-sectional view shown from the B-B direction of FIG. 4.

As shown in FIGS. 4, 5A, and 5B, the front structural members 7 comprise a first member 11 (corresponding to the blank) bent to have a U-shaped cross section; a second member 12 connected by welding to the first member 11; a circular opening 10 formed on the first member 11; and bosses 13, 20 connected to the first member 11 by welding. The frame 6 is inserted into the opening 10 and connected by welding, the bucket 4 is vertically pivotably supported by the boss 13, and a link 21 connecting the bucket 4 and the hydraulic cylinder 5 is horizontally pivotably supported by the boss 20.

As shown in FIGS. 4, 5A, and 5B, the first member 11 is bent to have a U-shaped cross section so as to have a bottom part 11*a* and a pair of walls 11*b*; the bottom part 11*a* of the first member 11 is bent into an arched surface of radius R1; and the edge of the wall 11*b* of the first member 11 is formed into an arch shape of radius R2 (corresponding to a predetermined shape of the edge of the wall 11*b* of the first member 11).

As shown in FIG. 2, and in the same manner as with the front structural members 7, the rear structural members 8 also comprise a first member (not shown) bent to have a U-shaped cross section, a second member (not shown) connected by welding to the first member, and a boss (not shown) connected by welding to the first member, wherein the bottom part of the first member is bend into an arched surface, and the edge of the wall part of the first member is formed into an arched shape. The bosses are vertically pivotably supported by the support frame 1, and an opening 10 provided to the front structural member 7 is not provided to the rear structural member 8.

The production of the front structural member 7 (the press-working method) is described hereunder.

Figure 6:
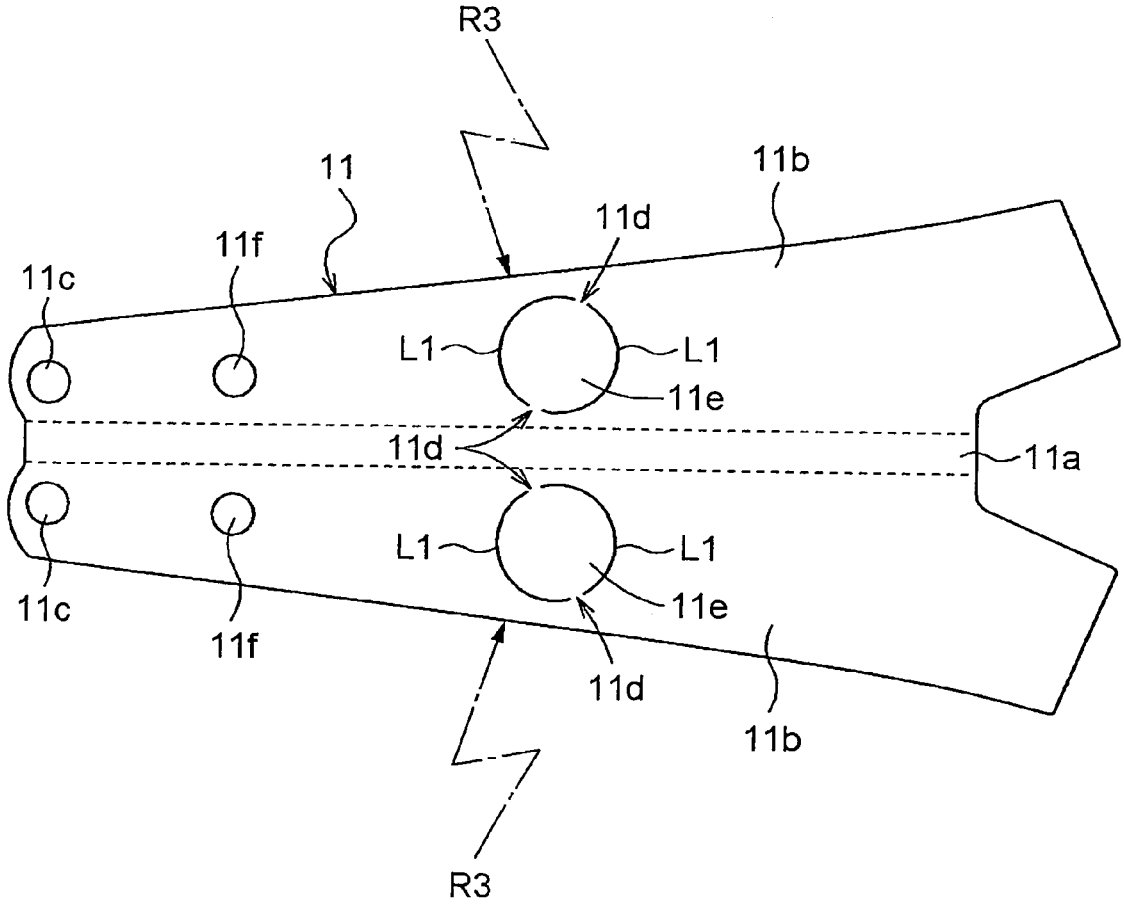
FIG. 6 is a plan view showing a state in which a first member has been cut out from a sheet material.

The first member 11 is cut with a laser from a sheet material, as shown in FIG. 6. Before the first member 11 is bent to have a U-shaped cross section, one bottom part 11*a* and two wall parts 11*b* of the first member 11 are cut out as a whole, and circular openings 11*c*, 11*f*, into which the bosses 13, 20 are inserted are formed (cut out) in the walls 11*b* (corresponding to a cutting-out step).

In this case, as shown in FIG. 6, the radius R3 of the edges of the walls 11*b* of the first member 11 is set to be slightly larger than the radius R2 (see FIG. 4) of the edges of the walls 11*b* of the first member 11 having a U-shaped cross-section (corresponding to a state in which the edges of the wall 11*b* of the first member 11 are extended in a second bending step described hereafter, whereby the edges of the walls 11*b* of the first member 11 are cut out so that the edges of the walls 11*b* of the first member 11 are formed into arches having radius R2).

As shown in FIG. 6, a pair of semicircular cut-out lines L1 (whose radii are the same as that of the opening 10; e.g., about 0.5 mm across) that pass through the wall 11*b* of the first member 11 are cut with a laser on the portion corresponding to the opening 10 of the wall 11*b* of the first member 11. A connecting part 11*d* (for example, about 1 mm across) for connecting the wall 11*b* of the first member 11 and a blank part 11*e* inside the opening 10 is formed between the ends of the cut-out lines L1 (a blank part 11*e* inside the opening 10 remains in the wall 11*b* of the first member 11). In this case, the position of the connecting part 11*d* of the first member 11 is set to a location near the bottom 11*a* of the first member 11 and the end of the wall 11*b*.

As shown in FIGS. 7A, 7B, and 8, a first pressing device 14 is prepared. The first pressing machine 14 is configured to comprise an inside first mold 15 (a plunger or a male die) and an outside first mold 16 (a die or a female die), wherein a lower part 15*a* of the inside first mold 15 and a bottom 16*a* of the outside first mold 16 are in a linear configuration as seen from a side surface (see FIG. 8). Accordingly, as shown in FIG. 7A, the cut-out first member 11 is placed on the outside first mold 16. As shown in FIG. 7B, the inside first mold 15 is lowered, and the first member 11 is thereby bent to have a U-shaped cross section by the inside and outside first molds 15, 16 (corresponding to a first bending step, which is a state in which the first member 11 is bent so as to be provided with a bottom 11*a* and walls 11*b*).

As shown in FIGS. 7B and 8, the lower part 15*a* of the inside first mold 15 and the bottom 16*a* of the outside first mold 16 are in a linear configuration as seen from the side (see FIG. 8), and the bottom 11*a* of the first member 11 is thereby formed to a linear (flat) shape. Accordingly, as shown in FIGS. 8 and 9, when the first member 11 is bent to have a U-shaped cross section, the wall 11*b* of the first member 11 is not compressed along the surface. Therefore, the connecting part 11*d* of the first member 11 remains unbroken, and the blank part 11*e* inside the opening 10 remains in the wall 11*b* of the first member 11. The outside first mold 16 is configured to be relatively shallow. When the first member 11 is bent to have a U-shaped cross section, the wall 11*b* of the first member 11 will be in a free state without being restricted by the inside and outside first molds 15, 16. Therefore, the end of the wall 11*b* of the first member 11 will remain substantially unchanged relative to the radius R3.

Figure 11:
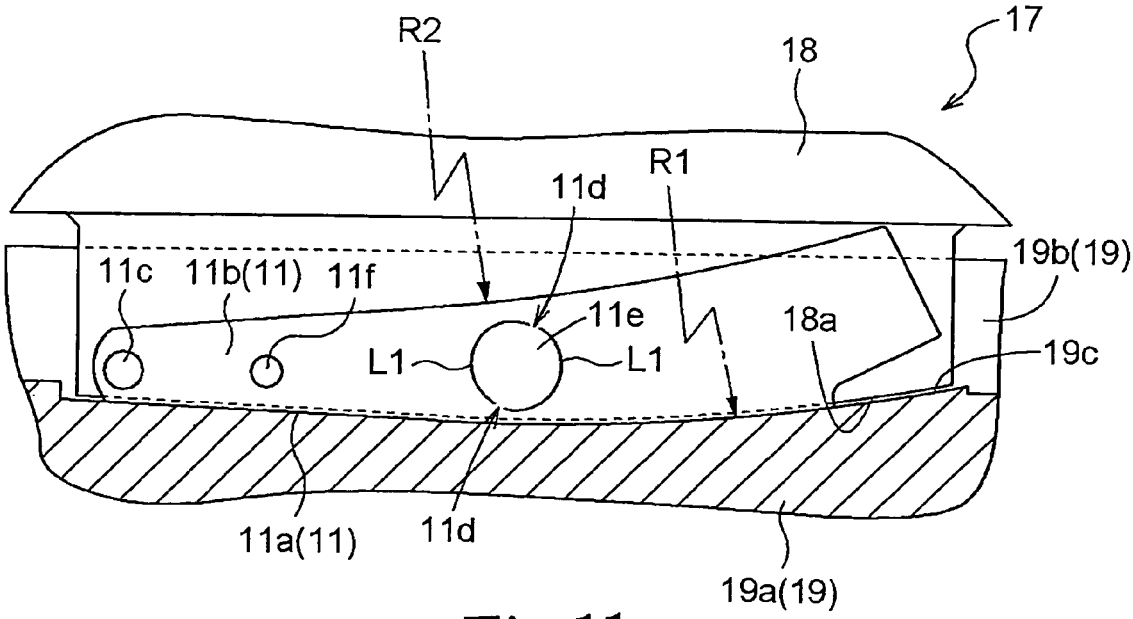
FIG. 11 is a longitudinal sectional front view showing a state in which the bottom of the first member is bent into an arched surface by the second pressing device.

As shown in FIGS. 10A, 10B, and 11, a second pressing device 17 is prepared. The second pressing device 17 is configured to comprise an inside second mold 18 (male die) and an outside second mold 19 (female die), wherein a lower part 18*a* of the inside second mold 18 is configured in the form of an arch having radius R1 as seen from the side surface (see FIG. 11). The outside second mold 19 is configured to comprise one bottom 19*a* and two walls 19*b*. The bottom 19*a* is raisably supported in a predetermined range along the walls 19*b*, and the upper part 19*c* of the bottom 19*a* is configured in the form of an arch having radius R1 as seen from the side surface (see FIG. 11).

As shown in FIG. 10A, the first member 11 that is bent to have a U-shaped cross section is placed within the outside second mold 19. As shown in FIG. 10B, the inside second mold 18 is lowered, and the inside second mold 18 enters the first member 11. When the inside second mold 18 is lowered further, the first member 11 and the bottom 19*a* of the outside second mold 19 are lowered as well, and the bottom 19*a* of the outside second mold 19 reaches a lowering limit and stops, whereupon the inside second mold 18 also stops.

As shown in FIGS. 11 and 13, the bottom 11*a* of the first member 11 is accordingly bent into an arched surface of radius R1 by the inside second mold 18 (the lower part 18*a*) and the outside second mold 19 (the bottom 19*a*). The inside second mold 18 and the outside second mold 19 (the bottom 19*b*) are in contact across the entire surface of the walls 11*b* of the first member 11 (see FIGS. 10B and 11). Changes in the thickness of the walls 11*b* of the first member 11 are thereby limited by the inside and outside second molds 18, 19, minimizing the rippled state (wrinkled state, or a state in which there are deformations in the thickness direction) in the walls 11*b* of the first member 11 (corresponding to a second bend-working step).

In this case, as shown in FIGS. 10B and 11, when the bottom 11*a* of the first member 11 is bent into an arched surface, the walls 11*b* of the first member 11 are compressed along the surface. However, the upper part (between the inside and outside second molds 18, 19) is opened from the edges of the walls 11*b* of the first member 11, and the edges of the walls 11*b* of the first member 11 are therefore allowed to expand or extend along the inside second mold 18 and the outside second mold 19 (the bottom 19*b*).

Thus, as shown in FIGS. 11 and 13, when the bottom 11*a* of the first member 11 is bent into an arched surface, the walls 11*b* of the first member 11 are compressed along the surface, and the edges of the walls 11*b* of the first member 11 thereby change from radius R3 to radius R2 (corresponding to a state in which the edges of the walls 11*b* of the first member 11 expand along the inside and outside second molds 18, 19 in cases in which the walls 11*b* of the first member 11 are compressed along the surface when the bottom 11*a* of the first member 11 is bent into an arched surface, thereby imparting a predetermined shape to the edges of the walls 11*b* of the first member 11).

As shown in FIG. 11, a risk is presented in that the outer periphery (the cut out line L1) of the opening 10 will deform along the surface in cases in which the walls 11*b* of the first member 11 are compressed along the surface when the bottom 11*a* of the first member 11 is bent into an arched surface. In this case, even if the outer periphery (the cut out line L1) of the opening 10 will deform along the surface, the outer periphery (the cut out line L1) of the opening 10 strikes the blank part 11*e* on the inside of the opening, and deformation of the outer periphery (the cut out line L1) of the opening 10 is controlled by the presence of the blank part 11*e* inside the opening 11.

Figure 12:
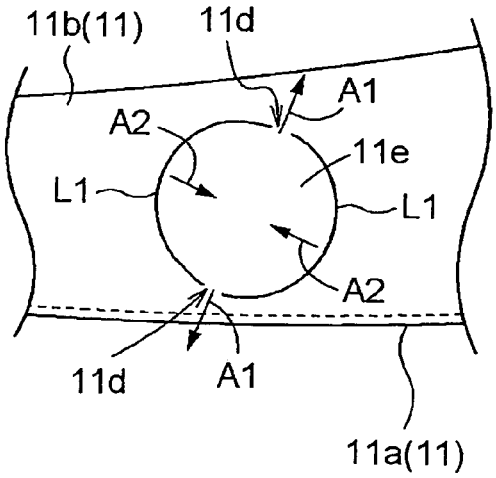
FIG. 12 is a side view of an area adjacent to a connecting part and the section line of the first member in a state in which the bottom part of the first member is bent into an arched surface by the second pressing device.

As shown in FIG. 12, the vicinity of the connecting part 11*d* in the walls 11*b* of the first member 11 will be outwardly displaced (see arrow A1) in the connecting part 11*d* of the first member 11 and the cut out line L1 in cases in which the walls 11*b* of the first member 11 are compressed along the surface when the bottom 11*a* of the first member 11 is bent into an arched surface. The connecting part 11*d* of the first member 11 thereby resists the above-described displacement (corresponding to a state in which the connecting part 11*d* of the first member 11 resists the outer contour of the opening 10 to be outwardly displaced). If the above-described displacement overcomes the connecting part 11*d* of the first member 11, the connecting part 11*d* of the member 11 will break, and the cut-out lines L1 will connect, as shown in FIG. 13.

As shown in FIG. 12, the vicinity of the center of the cut-out lines L1 in the walls 11*b* of the first member 11 will be inwardly displaced (see arrow A2) in cases in which the walls 11*b* of the first member 11 are compressed along the surface when the bottom 11*a* of the first member 11 is bent into an arched surface. The vicinity of the center of the cut-out lines L1 in the walls 11*b* of the first member 11 is thereby pressed by the blank part 11*e* inside the opening 10, and the blank part 11*e* inside the opening 10 is therefore supported by the walls 11*b* of the first member 11 by this pressing action. Accordingly, after the second bending step is completed, the first member 11 is removed from the second pressing device 17, and the blank part 11*e* inside the opening 10 is struck by a hammer or other implement, allowing the blank part 11*e* inside the opening 10 to be readily removed.

From the standpoint of production efficiency, a subsequent first member 11 may be bent to have a U-shaped cross section by the first bending step simultaneously with the abovementioned second bending step, and a state in which two first members 11 are simultaneously subjected to the first and second bending steps may be repeated. The rear structural member 8 is produced in the same manner as the above-described front structural member 7 except that an opening 10 is not provided.

First Alternative Embodiment of the Invention

When the pair of semicircular cut-out lines L1 and the connecting part 11*d* of the first member 11 are formed on a portion corresponding to the opening 10 of the walls 11*b* of the first member 11, as shown in FIG. 6 of the above-described Detailed Description of the Preferred Embodiments, the pair of semicircular cut-out lines L1 and the connecting part 11*d* of the first member 11 may be formed in an elliptical shape, as shown in FIG. 14. (As shown in FIG. 14, an elliptical shape is obtained so that the vicinity of the center of the cut-out lines L1 in the walls 11*b* of the first member 11 has a long radius R4, and the connecting part 11*d* of the first member 11 has a short radius R5. The long radius R4 is set to be substantially the same as the radius of the opening 10, and the short radius R5 is set to be slightly smaller than the radius of the opening 10.)

Accordingly, as shown in FIG. 12, the vicinity of the connecting part 11*d* in the walls 11*b* of the first member 11 will be outwardly displaced (see arrow A1), the connecting part

11*d* of the first member 11 will break, and the cut-out lines L1 will connect in the connecting part 11*d* of the first member 11 and the cut-out lines L1 in cases in which the walls 11*b* of the first member 11 are compressed along the surface when the bottom 11*a* of the first member 11 is bent into an arched surface.

Therefore, as shown in FIG. 14, the pair of semicircular cut-out lines L1 and the connecting part 11*d* of the first member 11 will be formed into an elliptical shape so that the connecting part 11*d* of the first member 11 will form the short radius R5. As a result, the vicinity of the connecting part 11*d* in the walls 11*b* of the first member 11 will be slightly displaced outwardly in the above-described manner, thereby yielding a circular opening 10.

Second Alternate Embodiment of the Invention

When the first member 11 is bent to have a U-shaped cross section (when the first member 11 is bent so as to provide a bottom 11*a* and walls 11*b*) in the above-described First Alternate Embodiment of the Invention of the Detailed Description of the Preferred Embodiments, the first member 11 may be bent to have a U-shaped cross section so that the cross section of the bottom 11*a* of the first member 11 will form an arched shape and not a linear shape (see FIGS. 5A and 5B).

A configuration may be obtained wherein the cut-out lines L1 and the connecting part 11*d* of the first member 11 shown in FIGS. 6 and 14 are eliminated, and a narrow groove is machined in the portion corresponding to the opening 10 of the wall 11*b* of the first member 11. The walls 11*b* of the first member 11 and the blank part 11*e* inside the opening 10 will thereby be connected by a thin part of the bottom of the groove.

The first member 11, rather than being bent to have a U-shaped cross section, may be bent to have a V-shaped cross section (the bottom 11*a* of the first member 11 assumes the form of a narrow line, and the two walls 11*b* of the first member 11 are provided with the same width (height)), a J-shaped cross section (the first member 11 is provided with one bottom 11*a* and two walls 11*b*, and the two walls 11*b* of the first member 11 are provided with differing widths (heights)), or an L-shaped cross section (the first member 11 is provided with one bottom 11*a* and one wall 11*b*).

The present invention can be applied not only to a boom 2 of a front loader (the front structural member 7 and the rear structural member 8), but also to a boom or arm of a backhoe; or an arm of a farm-working machine, a construction machine, or the like.

The abovementioned steps and the advantages thereof are described hereunder.

The press-working method preferably comprises one or more of the following steps.

A cutting-out step for cutting out a blank from a sheet material.

A bending step in which inside and outside molds are used for bending the blank so as to provide a bottom and walls, and bending the bottom of the blank into an arched surface.

In the bending step, the edges of the walls of the blank are allowed to expand or extend along the inside and outside molds while changes in the thickness of the walls of the blank are controlled by the inside and outside molds when the bottom of the blank is bent into an arched surface.

By being extended in the bending step, the edges of the walls of the blank will be cut out in the cutting-out step so that the edges of the walls of the blank will form a predetermined shape.

When the bottom of the blank is bent into an arched surface, changes in the thickness of the walls of the blanks are controlled by the inside and outside molds, and rippling (a wrinkled state, or a state in which deformation occurs in the thickness direction) of the walls of the blank is minimized. However, the edges of the walls of the blank are allowed to expand or extend along the inside and outside molds.

When the walls of the blank are compressed along the surface as the bottom of the blank is bent into an arched surface, the degree to which the edges of the walls of the blank will extend along the inside and outside molds can be readily calculated in advance if the edges of the walls of the blank are only allowed to extend in one direction (the direction along the inside and outside molds) in this manner. (For example, a plurality of types of blanks of different dimensions and materials can be prepared in advance, a trial in which the bottoms of this plurality of types of blanks are bent can be conducted, and the results of the trials can be used to predict the degree to which the edges of the walls of the blanks will extend along the inside and outside molds. For example, a computer-based simulation or another mathematical technique can be used to predict the degree to which the edges of the walls of the blanks extend along the inside and outside molds.)

The edges of the walls of the blanks can thereby be made to assume the predetermined shape by extending the edges of the walls of the blank along the inside and outside molds in cases in which the walls of the blanks are compressed along the surface when the bottom of the blank is bent into an arched surface if the edges of the walls of the blanks are cut out in the cutting-out step on the basis of the above-described predictions (e.g., the edges of the walls of the blanks are cut out to be partially slightly smaller than the predetermined shape, or are cut out to be slightly larger in certain regions than the predetermined shape).

In the press-working method whereby each of the blanks is bent to provide a bottom and walls, and the bottom of the blank is bent into an arched surface, rippling (a wrinkled state, or a state in which deformation occurs in the thickness direction) of the walls of the blank will be minimized, and, once the bending step has concluded, the edges of the walls of the blank will not need to be machined (small-scale and small-scope machining will suffice even if machining is necessary). Therefore, the press-working steps can be shortened and production costs can be reduced.

The press-working method preferably comprises the following steps:

A first bending step for bending a blank using inside and outside first molds so as to provide a bottom and walls, and a second bending step for bending the bottom of the blank into an arched surface by inside and outside second molds wherein the edges of the walls of the blank are allowed to extend along the inside and outside second molds while changes in the thickness of the walls of the blank are controlled by the inside and outside second molds.

Accordingly, in the first bending step, the blank is bent using the first inside and outside molds so as to have a bottom and sides. In the first bending step, the blank is merely bent; therefore, a conventional pressing device such any of those shown in FIGS. 7A, 7B, and 8 may be used.

In the second bending step, while changes in the thickness of the walls of the blank are controlled by the inside and outside second molds, the edges of the walls of the blank are allowed to extend along the inside and outside second molds, and the bottom of the blank is bent into an arched surface by the inside and outside second molds.

If, in such cases, the bottom of the blank is bent into an arched surface at the same time as the blank is bent so as to have a bottom and walls, a large pressing machine and a high-precision mold become necessary. In contrast, according to the second characteristic of the present invention, the blank is bent so as to have a bottom and walls (first bending step), whereupon the bottom of the blank is bent into an arched surface (second bending step). Therefore, a conventional pressing device and mold (second mold) that are capable of bending the bottom of the blank into an arched surface should be used.

As has been described in the foregoing, the use of a large pressing device capable of simultaneously bending a blank so as to provide a bottom and walls and bending the bottom of the blank into an arched surface entails a relatively large amount of time for one blank to be completely worked (the pressing rate of the molds can be increased only slightly), and production efficiency is low.

On the other hand, by providing the pressing device of the first bending step and the pressing device of the second bending step as separate units, it is possible for one blank to be bent by the pressing device of the first bending step so as to be provided with a bottom and walls, while at the same time the bottom of another blank is bent into an arched surface by the pressing device of the second bending step. Production efficiency can therefore be improved.

The press-working method preferably further comprises the following step:

a step in which a cut-out portion corresponding to the outer contour of the opening is formed in the cutting-out step on the wall of the blank while the portion of the blank inside the opening is allowed to remain if an opening of predetermined shape is to be formed in the walls of the blank.

In cases in which an opening of a predetermined shape is to be formed in the walls of the blank, a risk arises in that when the bottom of the blank is bent into an arched surface and the walls of the blank are compressed along the surface, the outer periphery of the opening will deform along the surface then when the opening of predetermined shape is formed on the walls of the blanks in the cutting-out step (a state in which no blank part is present inside the opening).

However, in the cutting-out step, the cut part corresponding to the outer contour of the opening is formed on the wall of the blank while leaving the blank part inside the opening. Therefore, even if the walls of the blank are compressed along the surface when the bottom of the blank is bent into an arched surface and the outer periphery of the opening deforms along the surface, the outer periphery of the opening will strike the blank part on the inside of the opening, and deformation of the outer periphery of the opening will be minimized by the presence of the blank part inside the opening.

In this case, the forming of the cut part so as to allow the blank part inside the opening to be remain makes it possible to readily remove the blank part inside the opening after the bending step is completed.

When an opening of a predetermined shape is formed on the walls of the blank, it will be possible to minimize deformation in the outer periphery of the opening and to improve the precision of the press-working method.

The press-working method preferably comprises the following step:

a step in which sectioning lines that pass through the wall of the blank, and a connection part for connecting the walls of the blank and the blank part inside the opening, are provided to form a cut part.

The walls of the blank and the blank part inside the opening are separated along the sectioning lines. In the connecting part, the walls of the blank and the blank part inside the opening are connected. Accordingly, by configuring the connecting part to be of the minimum requisite size, the blank part inside the opening can be readily removed after the bending step is completed.

The press-working process preferably comprises the following step:

a step in which a connecting part is provided in the bending step to the outer contour part of the opening that displaces outward.

If the bottom of the blank is to be bent into an arched surface and the walls of the blank are compressed along the surface, so that the outer periphery of the opening will deform along the surface, then according to the fifth characteristic of the present invention, a connecting part is provided to the outer contour part of the opening that displaces outward.

Accordingly, when the bottom of the blank is bent into an arched surface, the connecting part will form a resistance against the outer contour of the opening that is to be outwardly displaced from the predetermined shape.

If, when the bottom of the blank is bent into an arched surface, the outer contour part of the opening that is to displace outward overcomes the resistance of the connecting part, the connecting part will break. Therefore, the blank part inside the opening can be readily removed after the bending step is completed. (Even if the connecting part breaks, the outer contour part of the opening to be displaced inward will be pressed by the blank part inside the opening. Therefore, the blank part inside the opening will be supported by the walls of the blank by this pressing action, and, once the bending step is complete, the blank part inside the opening can be readily removed.)

Therefore, when the bottom of the blank is bent into an arched surface, the connecting part forms a resistance against the outer contour part of the opening to be displaced outward, which is useful in controlling the deformation of the outer periphery of the opening, and allows the precision of the press-working method to be enhanced.

What is claimed is:

1. A press-working method comprising:

cutting out a member with a predetermined shape from a sheet material, the member having a longitudinal direction;

forming a cut-out portion for forming an opening in the interior region of the member, while allowing a blank part to remain inside the cut-out portion, wherein the cut-out portion corresponds to an outer contour of the opening;

bending the member with the predetermined shape to form a bottom portion and a wall portion extending at an angle from the bottom portion as seen in a direction along the longitudinal direction such that the bottom portion has an arched surface as seen in a side view, using at least one plunger and at least one die, the step of bending comprising deforming the outer contour of the opening; and removing the blank part from the cut-out portion to form the opening, wherein an edge of the wall portion is allowed to expand along the plunger and the die while changes in a thickness of the wall portion is controlled by the plunger and the die, wherein the step of cutting out a member is performed such that the wall portion has an edge with a preset shape after the bending step, and wherein the step of bending further includes:

a first bending step for bending the member to form the bottom portion and the wall portion with a first plunger and a first die; and a second bending step for bending the bottom portion by a second plunger and a second die into having the arched surface while controlling the change in the thickness of the wall portion with the second plunger and the second die and while allowing the edge of the wall portion to expand along the second plunger and the second die.

2. A press-working method comprising:

cuffing out a member with a predetermined shape from a sheet material, the member having a longitudinal direction;

forming a cut-out portion for forming an opening in the interior region of the member, while allowing a blank part to remain inside the cut-out portion, wherein the cut-out portion corresponds to an outer contour of the opening;

bending the member with the predetermined shape such that the outer contour of the opening is deformed; and removing the blank part from the cut-out portion to form the opening.

3. A method according to claim 2, wherein the bending step includes bending the member with the predetermined shape to form a bottom portion and a wall portion extending at an angle from the bottom portion as seen in a direction along the longitudinal direction such that the bottom portion has an arched surface as seen in a side view, using at least one plunger and at least one die.

4. A method according to claim 2, wherein the bending step includes a first bending step for bending the member to form the bottom portion and the wall portion with a first plunger and a first die; and a second bending step for bending the bottom portion by a second plunger and a second die into having the arched surface while controlling the change in the thickness of the wall portion with the second plunger and the second die and while allowing the edge of the wall portion to expand along the second plunger and the second die.

5. A method according to claim 2, wherein the cut-out portion includes cut-out lines that perforate through the wall portion and connecting portions connecting the wall portion and the blank part inside the opening.

6. A method according to claim 2, wherein the cut-out portion is dimensioned such that the blank part comes to be supported by a part of the member surrounding the opening by abutment thereagainst in the bending step.

7. A method according to claim 2, wherein the outer contour of the opening is substantially either a circle or an ellipse.

8. A press-working method comprising:

cutting out a member with a predetermined shape from a sheet material, the member having a longitudinal direction;

forming a cut-out portion for forming an opening in the member with the predetermined shape, while allowing a blank part to remain inside the cut-out portion, wherein the cut-out portion corresponds to an outer contour of the opening; and bending the member with the predetermined shape such that the outer contour of the opening is deformed, wherein connecting portions are formed in the outer regions of the opening that are displaced outwardly in the bending step, and wherein dimensions of the connecting portions are such that the connecting portions are severed in the bending step.

9. A method according to claim 8, wherein the step of bending includes:

a first bending step for bending the member to form a bottom portion and a wall portion with a first plunger and a first die; and a second bending step for bending the bottom portion by a second plunger and a second die into having the arched surface while controlling the change in the thickness of the wall portion with the second plunger and the second die and while allowing an edge of the wall portion to expand along the second plunger and the second die.

10. A method according to claim 8, wherein the bending step includes bending the member with the predetermined shape to form a bottom portion and a wall portion extending at an angle from the bottom portion as seen in a direction along the longitudinal direction such that the bottom portion has an arched surface as seen in a side view, using at least one plunger and at least one die.

11. A method according to claim 10, wherein the cut-out portion includes cut-out lines that perforate through the wall portion and connecting portions connecting the wall portion and the blank part inside the opening.

12. A method according to claim 8, wherein the outer contour of the opening is substantially either a circle or an ellipse.

* * * * *

UNITED STATES PATENT AND TRADEMARK OFFICE

CERTIFICATE OF CORRECTION

PATENT NO. : 7,628,050 B2
APPLICATION NO. : 11/519187
DATED : December 8, 2009
INVENTOR(S) : Nishi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 269 days.

Signed and Sealed this

Second Day of November, 2010

David J. Kappos

David J. Kappos
*Director of the United States Patent and Trademark Office*